US008898956B2

(12) United States Patent
Nam

(10) Patent No.: US 8,898,956 B2
(45) Date of Patent: Dec. 2, 2014

(54) SLIDING DOOR DEVICE FOR VEHICLE WITH PRESSURE SENSING UNIT AND SEALING UNIT

(71) Applicant: Hyundai Motor Company, Seoul (KR)

(72) Inventor: Kyunghyun Nam, Jeollabuk-do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/902,578

(22) Filed: May 24, 2013

(65) Prior Publication Data

US 2014/0157671 A1 Jun. 12, 2014

(30) Foreign Application Priority Data

Dec. 6, 2012 (KR) ..... 10-2012-0141299

(51) Int. Cl.
*E05F 15/00* (2006.01)

(52) U.S. Cl.
CPC ..... *E05F 15/0078* (2013.01); *E05Y 2900/531* (2013.01)
USPC ..... 49/27; 49/26; 49/483.1; 49/477.1

(58) Field of Classification Search
USPC ..... 49/26–28, 483.1, 477.1
See application file for complete search history.

(56) References Cited

U.S. PATENT DOCUMENTS

| | | | | | |
|---|---|---|---|---|---|
| 3,161,229 | A | * | 12/1964 | Sanders | 160/40 |
| 3,916,567 | A | * | 11/1975 | Daugirdas | 49/28 |
| 4,051,336 | A | * | 9/1977 | Miller | 200/61.43 |
| 4,273,974 | A | * | 6/1981 | Miller | 200/61.43 |
| 4,761,917 | A | * | 8/1988 | Knecht et al. | 49/477.1 |
| 4,773,183 | A | * | 9/1988 | Okushima et al. | 49/28 |
| 5,191,268 | A | * | 3/1993 | Duhame | 318/266 |
| 5,285,136 | A | * | 2/1994 | Duhame | 318/266 |
| 6,125,591 | A | * | 10/2000 | Schmidhuber et al. | 49/477.1 |
| 6,427,382 | B2 | * | 8/2002 | Gregoriou et al. | 49/27 |
| 6,481,157 | B1 | * | 11/2002 | Haake et al. | 49/26 |

* cited by examiner

*Primary Examiner* — Katherine Mitchell
*Assistant Examiner* — Marcus Menezes
(74) *Attorney, Agent, or Firm* — McDermott Will & Emery LLP

(57) ABSTRACT

A sliding door device for a vehicle includes a sliding door installed to be slidingly moved, a door weather strip attached to the sliding door, a pressure switch for sensing internal pressure of the door weather strip, a pneumatic line for connecting the door weather strip and the pressure switch to communicate with each other, an electronic control unit (ECU) for receiving a sensing signal of the pressure switch to control opening and closing of the sliding door, and an opening and closing valve for having the pneumatic line communicate with the atmospheric pressure or blocking the pneumatic line from the atmospheric pressure. Therefore, it is possible to effectively prevent an object or an occupant from being jammed in a process of closing the sliding door.

8 Claims, 5 Drawing Sheets

SLIDING DOOR DEVICE FOR VEHICLE WITH PRESSURE SENSING UNIT AND SEALING UNIT

CROSS-REFERENCE TO RELATED APPLICATION

This application claims priority to Korean Patent Application No. 10-2012-0141299 filed in the Korean Intellectual Property Office on Dec. 6, 2012, the entire contents of which are incorporated herein by reference.

FIELD

The present disclosure relates to a sliding door device for a vehicle. More particularly, the present disclosure relates to a sliding door device for a vehicle capable of preventing an object or an occupant from being jammed in a sliding door in a process of closing the sliding door.

BACKGROUND

In general, a sliding door device is applied to a large commercial vehicle such as a bus and a van so that a large number of occupants may easily get on and off.

The sliding door device includes a sliding door installed to move along a guide rail provided in a vehicle body to open and close a door opening in the vehicle body that is an entrance to the vehicle. A pneumatic cylinder, as a power source moves the sliding door, and a micro switch senses the closing of the sliding door. A controller controls the pneumatic cylinder based on a sensing signal of the micro switch to control the opening and closing of the sliding door.

In addition, the sliding door device ensures a sliding door safely closing function to prevent an object from being damaged or an occupant from being injured when the object or the occupant is jammed in a space between the sliding door and the door opening in a process of closing the sliding door where the sliding door blocks the door opening.

That is, in the sliding door safely closing function, when the object or the occupant is jammed in the space between the sliding door and the door opening in the process of closing the sliding door, the sliding door moves in a reverse direction, that is, in a direction where the door opening is opened so that it is possible to prevent the object or the occupant from being jammed.

In a method of sensing that the object or the occupant is jammed, a change in an internal pressure of a weather strip attached to the sliding door is used to release shock and to maintain air-tightness. That is, when the object or the occupant is jammed, a pressure is applied to the weather strip to generate a change in the pressure. The change in the internal pressure of the weather strip is sensed to determine whether the object or the occupant is jammed.

According to the above-described conventional sliding door device, in a predetermined range, for example 30 mm, immediately before the sliding door is completely closed, jamming of the object or the occupant is ignored, and closing of the sliding door continues, although an object such as clothes or a shoulder strap of an occupant or a part of the occupant's body is jammed in the sliding door. This ignorance purports to prevent a malfunction caused by compression of the weather strip when the sliding door is closed, but, as a result, may damage the object or injure the occupant.

On an incline, the sliding door may be closed by self-load before the micro switch senses the closing of the sliding door so that erroneous sensing in which the micro switch may not correctly sense the closing of the sliding door may be generated. In order to prevent the erroneous sensing, a point in time when the closing of the sliding door is recognized by the micro switch is set to be earlier than a point in time when the closing of the sliding door is completed at a predetermined interval, for example, 30 mm.

Therefore, even if leaving the predetermined interval before the completion of closing of the door, the jamming problem of the object or occupant still exists.

In addition, in a method of sensing that the object or the occupant is jammed, since the internal pressure of the weather strip changes in accordance with a change in peripheral temperature of the weather strip, a malfunction may be caused. For example, it is determined that the object or the occupant is jammed only when pressure of no less than predetermined pressure, for example, pressure of no less than 4.5 kgf is sensed in the weather strip.

Therefore, when an object or a part of an occupant's body of no more than, for example, 30×60 mm is jammed, it is not sensed that the object or the occupant is jammed and, thus, the closing of the sliding door continues so that the object may be damaged or the occupant may be injured and a vehicle is driven in a state where the occupant is jammed in the sliding door, which may incur a casualty accident.

The above information disclosed in this Background section is only for enhancement of understanding of the background of the invention and therefore it may contain information that does not form the prior art that is already known in this country to a person of ordinary skill in the art.

SUMMARY

An exemplary embodiment of the present disclosure provides a sliding door device for a vehicle in which a sliding door is opened again when an object or an occupant is jammed in a space between the sliding door and a door opening of a vehicle body in a process of closing the sliding door so that it is possible to prevent a safety accident from occurring.

An exemplary embodiment of the present disclosure, provides a sliding door device for a vehicle, including a sliding door installed to slidingly move, a door weather strip attached to the sliding door, a pressure switch for sensing an internal pressure of the door weather strip, a pneumatic line for connecting the door weather strip and the pressure switch to communicate with each other, an electronic control unit (ECU) for receiving a sensing signal of the pressure switch to control opening and closing of the sliding door, and an opening and closing valve for having the pneumatic line communicate with the atmospheric pressure or blocking the pneumatic line from the atmospheric pressure.

The opening and closing valve may have the pneumatic line communicate with the atmospheric pressure when the sliding door is opened and may block the pneumatic line from the atmospheric pressure when the sliding door is closed.

The opening and closing valve may include a solenoid valve whose on or off operation is controlled by the ECU.

The sliding door device for a vehicle may include a micro switch for sensing the closing of the sliding door. The ECU may control the sliding door so that the sliding door is not opened although the sensing signal is received by the pressure switch after a few seconds pass after the closing of the sliding door is completed by the micro switch.

A holder may be mounted in the sliding door. The door weather strip may include a base inserted into the holder, a pressure sensing unit integrated with the base and extending from the base, having a hollow closed section, and connected to the pressure switch through the pneumatic line, and an elastic sealing unit integrated with the base and extending from the base and protruding above the pressure sensing unit.

The elastic sealing unit may include a sealing unit having a circular hollow closed section and an elastically curved lever for connecting the sealing unit and the base to each other.

The elastic sealing unit may be bent toward the outside of a vehicle compartment by the lever when an external force is applied to press the pressure sensing unit.

The ECU may sense a change in the internal pressure of the pressure sensing unit through the pressure switch to control the sliding door so that the sliding door is opened when the internal pressure is no less than predetermined pressure.

A door stopper may be mounted in the door weather strip, and stays close to a vehicle body stopper so that the closing of the sliding door is restricted in a process of closing the sliding door.

The door stopper may be formed of a material having larger stiffness than that of the door weather strip or may be formed to have a shape of larger stiffness than that of the door weather strip.

The sliding door device for a vehicle may further include a pneumatic cylinder as a power source for moving the sliding door and an operation line for connecting the pneumatic cylinder and the sliding door to each other so that an operating force of the pneumatic cylinder is transmitted to the sliding door.

In the sliding door device for a vehicle according to the exemplary embodiment of the present disclosure, it is possible to effectively prevent the object or the occupant from being jammed in the sliding door in the process of closing the sliding door.

Although an object with small width and thickness or a part of an occupant's body is jammed in the sliding door, the object or the occupant may be easily pulled out so that it is possible to prevent the object from being damaged and the occupant from being injured.

Sensing ability of sensing that the object or the occupant is jammed in the sliding door is improved so that operability and commercial value of the sliding door may be improved.

DETAILED DESCRIPTION OF THE EMBODIMENTS

Hereinafter, an exemplary embodiment of the present disclosure will be described in detail with reference to the accompanying drawings.

Figure 1:
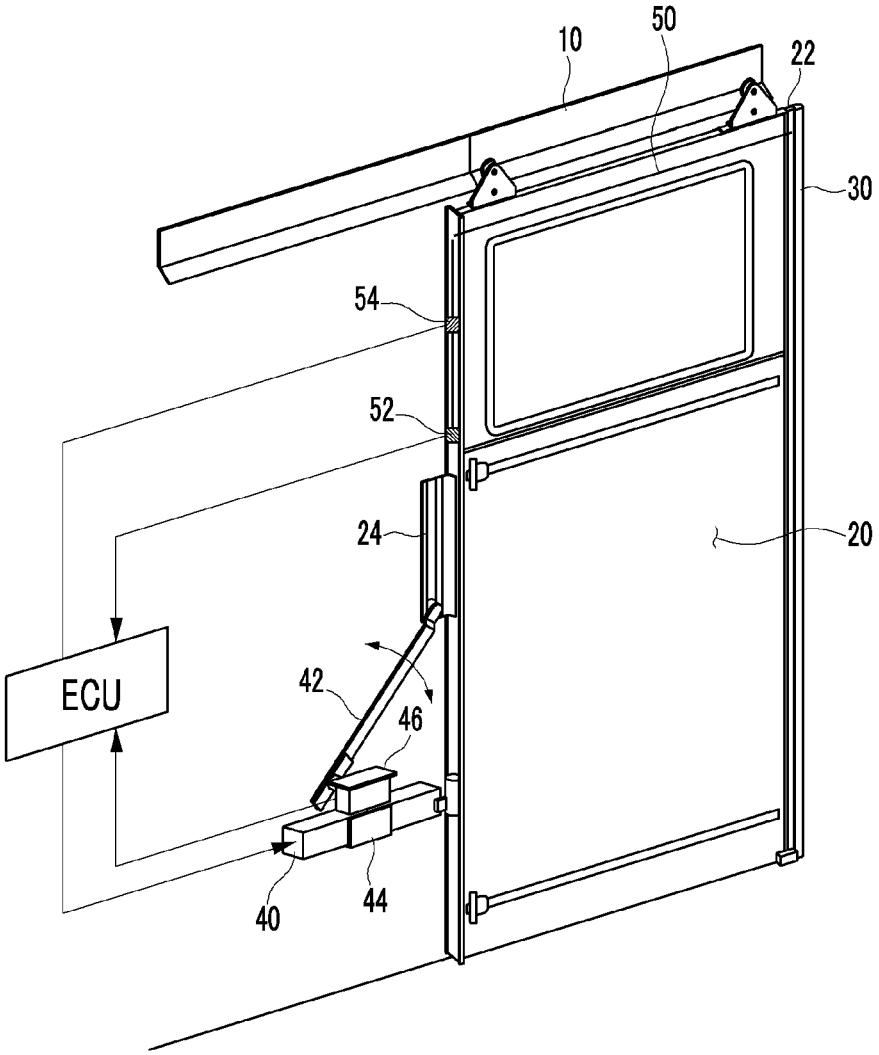
FIG. 1 is a block diagram of a sliding door for a vehicle according to an exemplary embodiment of the present disclosure.

Referring to FIG. 1, a sliding door device for a vehicle according to an exemplary embodiment of the present disclosure includes a sliding door 20 installed to slidingly move along a guide rail 10 mounted in a vehicle body. The guide rail 10 includes an L-shaped section and is extendedly installed in a longitudinal direction of a vehicle.

Two rollers 21 are mounted on the sliding door 20 so that the two rollers 21 are guided to a determined orbit and move along the guide rail 10 in a state of being settled in the guide rail 10.

The sliding door 20 is rectangular.

In FIG. 1, the sliding door 20 closes a door opening (not shown) formed in the vehicle body.

A door weather strip 22 is attached at one edge of the sliding door 20 in a longitudinal direction of the sliding door 20.

In addition, a vehicle body weather strip 30 is attached at an edge of the door opening of the vehicle body to correspond to the weather strip 22 of the sliding door 20.

The sliding door 20 moves to close the door opening of the vehicle body and the door weather strip 22 and the vehicle body weather strip 30 stay close to each other to maintain air-tightness.

A pneumatic cylinder 40 is used as a power source for moving the sliding door 20. Other appropriate power sources may be used in addition to or in replacement of the pneumatic cylinder 40.

The pneumatic cylinder 40 is connected to the sliding door 20 through an operation link 42.

A guide bracket 24, which the operation line 42 is inserted into and moves in, is mounted in the sliding door 20.

The operation link 42 is rotatably installed around a rotating shaft 44 so that the operation link 42 receives locomotion from the pneumatic cylinder 40 when the pneumatic cylinder 40 moves toward or away from the operation link 42 and rotates around the rotating shaft 44 to push or pull the sliding door 20 and to slidingly move the sliding door 20.

In order to sense the internal pressure of the door weather strip 22, a pneumatic line 50 is connected to the door weather strip 22 and a pressure switch 52 is installed in the pneumatic line 50.

When the door weather strip 22 receives an external force so that a shape and a volume of the door weather strip 22 change and the internal pressure of the door weather strip 22 changes, the pressure switch 52 senses the changed internal pressure of the door weather strip through the pneumatic line 50.

The pressure switch 52 is switched when the internal pressure of the door weather strip 22 is, for example, 1.0±0.5 kgf per unit area and is connected to an electronic control unit (ECU) 80 to input a switching signal to the ECU 80.

When peripheral temperature of the door weather strip 22 rises, the internal temperature of the door weather strip 22 rises and the internal pressure of the door weather strip 22 increases so that the pressure switch 52 may input a malfunction signal, caused not by an object or an occupant being jammed but by a change in outside temperature, to the ECU 80.

In order to prevent the internal temperature of the door weather strip 22 from rising and the internal pressure of the door weather strip 22 from increasing, an opening and closing valve 54 is installed in the pneumatic line 50. The opening and closing valve 54 makes the pneumatic line 50 to communicate with atmospheric pressure or blocks the pneumatic line 50 from atmospheric pressure to close and seal the pneumatic line 50.

The opening and closing valve 54 may be formed of, for example, a solenoid valve.

An on or off operation of the opening and closing valve 54 may be controlled in accordance with a control signal of the ECU 80.

The opening and closing valve 54 is turned on when the sliding door 20 is opened to open the pneumatic line 50 so that the inside of the door weather strip 22 communicates with the atmospheric pressure so that the internal pressure of the door weather strip 22 is maintained as the atmospheric pressure. Therefore, it is possible to prevent a malfunction of the pressure switch 52 from being generated by a rise in the internal temperature of the door weather strip 22 and an increase in the internal pressure of the door weather strip 22 in accordance with a rise in the peripheral temperature of the door weather strip 22.

When the sliding door 20 is closed, the opening and closing valve 54 is turned off so that the pneumatic line 50 is blocked from the atmospheric pressure to maintain air-tightness. Therefore, the pressure switch 52 may smoothly check a change in the internal pressure of the door weather strip 22.

When the object or the occupant is jammed in a space between the sliding door 20 and the door opening in a process of closing the sliding door 20, the door weather strip 22 is compressed and transformed by the object or the occupant so that the internal pressure of the door weather strip 22 is increased.

When the internal pressure of the door weather strip 22 is increased to, for example, no less than 1.0 kgf per unit area, the pressure switch 52 is switched to input the switching signal to the ECU 80 and the ECU 80 receives the switching signal of the pressure switch 52 to control an operation of the pneumatic cylinder 40 so that the sliding door 20 operates in a direction where the door opening is opened. Therefore, it is possible to effectively prevent the object or the occupant from being jammed in the process of closing the sliding door 20.

A micro switch 46 for sensing the closing of the sliding door 20 is installed in the pneumatic cylinder 40.

The micro switch 46 may indirectly sense the closing of the sliding door 20 by the medium of an amount of rotation of the operation link 42 or stroke of the pneumatic cylinder 40.

When the closing of the sliding door 20 is normally completed without the occupant or the object being jammed in the process of closing the sliding door 20, the micro switch 46 is switched to input a signal to the ECU 80 and the ECU 80 determines whether the closing of the sliding door 20 is completed based on the input signal of the micro switch 46.

When the switching signal is received from the pressure switch 52 after a predetermined time, for example, a few seconds pass in a state where it is determined that the closing of the sliding door 20 is completed based on the input signal of the micro switch 46, the ECU 80 ignores the switching signal of the pressure switch 52 not to open the sliding door 20.

The sliding door 20 is prevented from being opened in a state where the internal pressure of the door weather strip 22 may be increased by a rise in temperature while a vehicle is driven or stopped.

Figure 2:
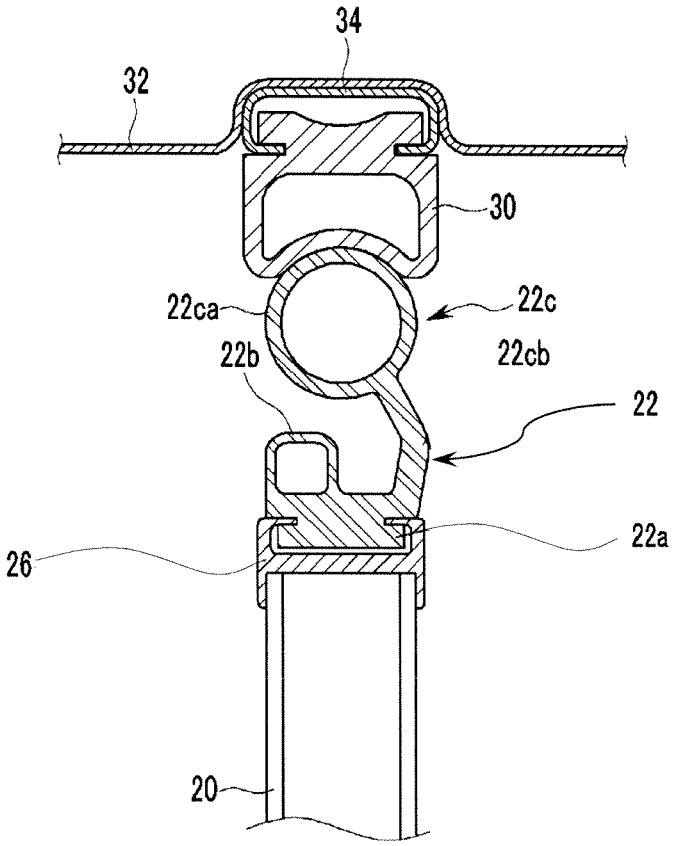
FIG. 2 is a cross-sectional view of a door weather strip and a vehicle body weather strip according to an exemplary embodiment of the present disclosure.

FIG. 2 is a cross-sectional view illustrating structures of the door weather strip 22 and the vehicle body weather strip 30. The door weather strip 22 is fixedly attached to the edge of the sliding door 20 by an appropriate fixing device such as a bracket or a holder 26.

The door weather strip 22 includes a base 22*a* to be inserted into the holder 26, a pressure sensing unit 22*b* integrated with the base 22*a* to extend from the base 22*a* and having a hollow closed section, and an elastic sealing unit 22*c* integrated with the base 22*a* to extend from the base 22*a* and to protrude above the pressure sensing unit 22*b*.

The pressure sensing unit 22*b* is connected to the pressure switch 52 to communicate with the pressure switch 52 through the pneumatic line 50.

The elastic sealing unit 22*c* includes a sealing unit 22*ca* having a circular hollow closed section and an elastically curved lever 22*cb* for connecting the sealing unit 22*ca* and the base 22*a*.

The vehicle body weather strip 30 is fixedly attached along the edge of the door opening formed in a vehicle body 32 by an appropriate holder 34.

The vehicle body weather strip 30 is square and has a hollow closed section formed therein.

Therefore, as illustrated in FIG. 2, when the sliding door 20 completely closes the door opening, the sealing unit 22*ca* of the door weather strip 22 stays close to an opposite surface of the vehicle body weather strip 30 to seal the door opening.

Figure 4:
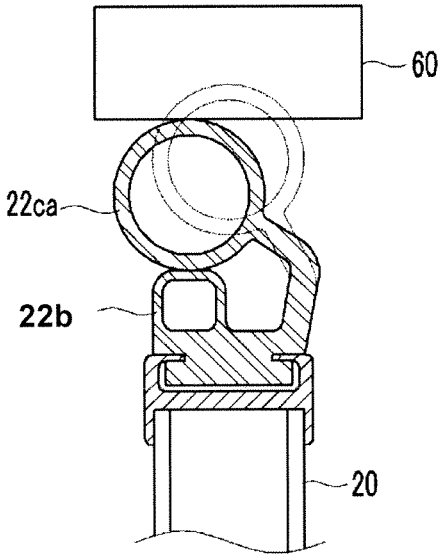
FIG. 4 is a cross-sectional view describing an operation of a door weather strip according to an exemplary embodiment of the present disclosure when an object is jammed in a process of closing a sliding door.

Referring to FIG. 4, when an object 60 or a part of an occupant's body is jammed between the sliding door 20 and the door opening of the vehicle body in the process of closing the sliding door 20, the sealing unit 22*ca* is pressed toward the pressure sensing unit 22*b* by the lever 22*ca* and the pressure sensing unit 22*b* is pressed by the sealing unit 22*ca* to be compressed and transformed so that internal pressure of the pressure sensing unit 22*b* is changed. Such a change in pressure is sensed by the pressure switch 52.

The ECU 80 operates the pneumatic cylinder 40 in accordance with a sensing signal input by the pressure switch 52 so that the sliding door 20 is opened. Therefore, it is possible to prevent the object or the occupant from being jammed in the process of closing the sliding door 20.

Figure 3:
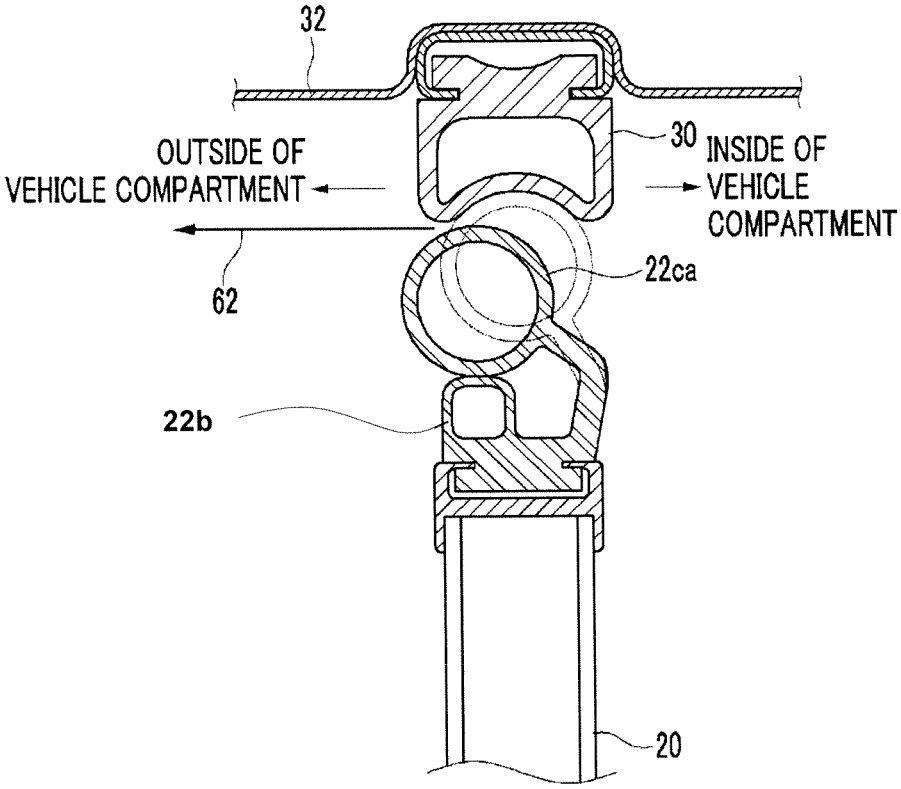
FIG. 3 is a cross-sectional view describing an operation of a door weather strip according to an exemplary embodiment of the present disclosure when a jammed object is pulled in a process of closing a sliding door.

Referring to FIG. 3, in a state where an object 62 having small width and thickness such as a shoulder strap is jammed between the sliding door 20 and the door opening of the vehicle body in the process of closing the sliding door 20 or when the sliding door 20 is completely closed, when the object 62 is pulled toward the outside of a vehicle compartment to pull the object 62 out of the vehicle compartment, since the sealing unit 22*ca* is bent toward the outside of the vehicle compartment by the lever 22*cb*, the object 62 may be easily pulled out of the vehicle compartment.

In addition, in a process of pulling the object 62 out of the vehicle compartment, an external force is applied to the sealing unit 22*ca* so that the sealing unit 22*ca* is pressed toward the pressure sensing unit 22*b* by the lever 22*ca* and the pressure sensing unit 22*b* is pressed by the sealing unit 22*ca* to be compressed and transformed so that the internal pressure of the pressure sensing unit 22*b* changes. The ECU 80 senses such a change in pressure through the pressure switch 52 to enable the sliding door 20 to be opened. Therefore, although the object 62 having small width and thickness such as the shoulder strap is jammed in the sliding door, the object 62 may be easily pulled out of the vehicle compartment.

Figure 5:
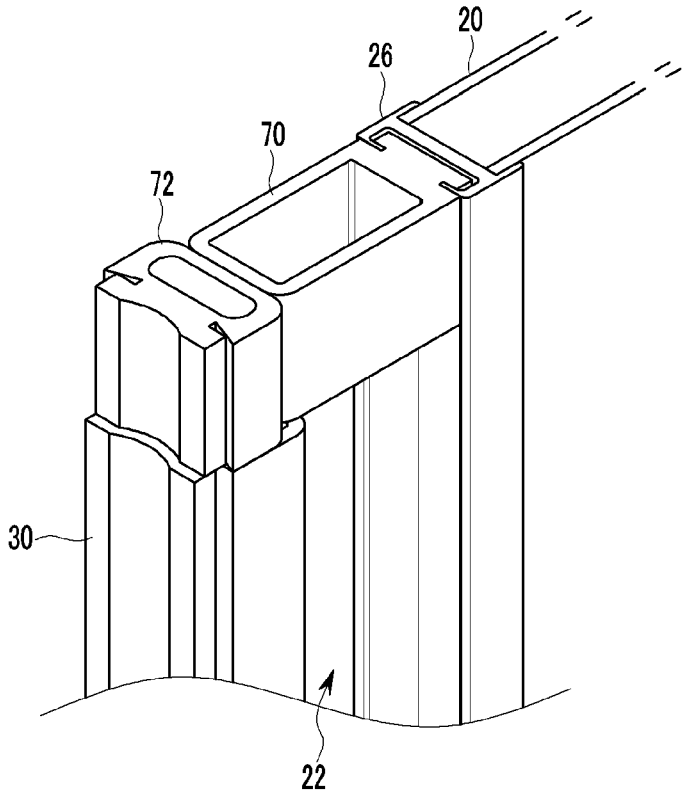
FIG. 5 is a perspective view illustrating a state in which a vehicle body stopper and a door stopper according to an exemplary embodiment of the present disclosure are mounted.

Referring to FIG. 5, a door stopper 70 formed of a material having larger stiffness than that of the door weather strip 22 or formed to have larger stiffness than that of the door weather strip 22 is mounted in an upper end of the sliding door 20 and a vehicle body stopper 72 corresponding to the door stopper 70 is mounted in an upper end of the vehicle body weather strip 30.

When the sliding door 20 is completely closed, the door stopper 70 contacts the vehicle body stopper 72 so that a state in which the closing of the sliding door 20 is completed is maintained and excessive load is prevented from being applied to the sealing unit 22*ca* in the state where the closing of the sliding door 20 is completed. Therefore, it is possible to prevent a malfunction of pressure sensing from being generated.

While this disclosure has been described in connection with what is presently considered to be practical exemplary embodiments, it is to be understood that the inventive concept is not limited to the disclosed embodiments, but, on the contrary, is intended to cover various modifications and equivalent arrangements included within the spirit and scope of the appended claims.

What is claimed is:

1. A sliding door device for a vehicle, comprising:

a sliding door configured to slidingly move;

a door weather strip attached to the sliding door;

a pressure switch configured to sense an internal pressure of the door weather strip;

a pneumatic line connecting the door weather strip and the pressure switch to communicate with each other;

an electronic control unit (ECU) configured to receive a switching signal from the pressure switch to control opening and closing of the sliding door; and an opening and closing valve configured to cause the pneumatic line to communicate with atmospheric pressure or cause the pneumatic line to be blocked from the atmospheric pressure, wherein:

a holder is disposed on the sliding door, the door weather strip comprises:

a base disposed into the holder;

a pressure sensing unit integrated with the base, extending from the base and having a hollow closed section; and an elastic sealing unit integrated with the base, extending from the base and protruding above the pressure sensing unit, and the elastic sealing unit comprises:

a circular sealing unit having a circular hollow closed section; and an elastically curved lever connecting the circular sealing unit and the base, the base is connected between the circular sealing unit and the pressure sensing unit such that the circular sealing unit is free of contact with the pressure sensing unit when no external force is applied to the circular sealing unit, and when an external force is applied to the circular sealing unit, the circular sealing unit is bent toward an outside of a vehicle compartment to be in contact with the pressure sensing unit by the lever.

2. The sliding door device for a vehicle of claim 1, wherein the opening and closing valve has the pneumatic line communicate with the atmospheric pressure when the sliding door is opened and blocks the pneumatic line from the atmospheric pressure when the sliding door is closed.

3. The sliding door device for a vehicle of claim 1, wherein the opening and closing valve comprises a solenoid valve whose on or off operation is controlled by the ECU.

4. The sliding door device for a vehicle of claim , further comprising a micro switch configured to sense the closing of the sliding door, wherein the ECU controls the sliding door such that the sliding door is not opened when the switching signal is received from the pressure switch and a few seconds pass from the time when the closing of the sliding door is sensed by the micro switch.

5. The sliding door device for a vehicle of claim 1, wherein the ECU senses a change in internal pressure of the pressure sensing unit through the pressure switch to control the sliding door so that the sliding door is opened when the internal pressure is no less than a predetermined pressure.

6. The sliding door device for a vehicle of claim 1, wherein a door stopper is disposed on the door weather strip and a vehicle body stopper is disposed on a vehicle body weather strip such that the door stopper is in contact with the vehicle body stopper when the sliding door is closed.

7. The sliding door device for a vehicle of claim 6, wherein the door stopper is formed of a material having larger stiffness than stiffness of the door weather strip.

8. The sliding door device for a vehicle of claim 1, further comprising:

a pneumatic cylinder as a power source for moving the sliding door; and an operation line for connecting the pneumatic cylinder and the sliding door to each other so that an operating force of the pneumatic cylinder is transmitted to the sliding door.

* * * * *